US008940988B1

(12) United States Patent
Harrison

(10) Patent No.: US 8,940,988 B1
(45) Date of Patent: Jan. 27, 2015

(54) SINGLE REED WOODWIND LIGATURE SYSTEM ADJUSTS TO FIT MOST MOUTHPIECE SIZES WITH EXCELLENT RESPONSIVENESS THROUGH ISOLATION OF LIGATURE FROM REED AND MOUTHPIECE VIBRATIONS

(71) Applicant: Joel N Harrison, Campbell, CA (US)

(72) Inventor: Joel N Harrison, Campbell, CA (US)

( * ) Notice: Subject to any disclaimer, the term of this patent is extended or adjusted under 35 U.S.C. 154(b) by 0 days.

(21) Appl. No.: 13/974,016

(22) Filed: Aug. 22, 2013

(51) Int. Cl.
*G10D 9/02* (2006.01)

(52) U.S. Cl.
CPC ..... *G10D 9/02* (2013.01)
USPC ..... 84/383 R

(58) Field of Classification Search
CPC ..... G10D 9/02
See application file for complete search history.

(56) References Cited

U.S. PATENT DOCUMENTS

| | | | | | |
|---|---|---|---|---|---|
| 554,242 | A * | 2/1896 | Clapp | 84/383 R |
| 1,449,868 | A * | 3/1923 | Miller | 84/383 R |
| 4,056,997 | A | 11/1977 | Rovner | |
| 4,275,636 | A | 6/1981 | Van Doren | |
| 4,941,385 | A * | 7/1990 | Johnson | 84/383 R |
| 5,000,073 | A | 3/1991 | Hite | |
| 5,998,715 | A * | 12/1999 | Rovner | 84/383 R |
| 6,130,376 | A | 10/2000 | Chang | |
| 6,670,534 | B2 * | 12/2003 | Vildosola Erdociain | 84/383 R |
| 7,737,350 | B2 | 6/2010 | Wanne | |
| 7,763,787 | B2 * | 7/2010 | Jean | 84/380 R |
| 8,217,248 | B1 * | 7/2012 | Feliciano | 84/383 R |
| 2004/0177743 | A1 * | 9/2004 | Jo | 84/380 R |

FOREIGN PATENT DOCUMENTS

JP 07064542 A * 3/1995

* cited by examiner

*Primary Examiner* — Robert W Horn

(57) ABSTRACT

A single reed ligature system for a woodwind musical instrument that provides a large vertical range of adjustment to enable a single ligature to be used with most sizes of saxophone and clarinet mouthpieces. Excellent responsiveness to the player is achieved through isolation of the ligature from the vibrating reed and mouthpiece.

19 Claims, 8 Drawing Sheets

SINGLE REED WOODWIND LIGATURE SYSTEM ADJUSTS TO FIT MOST MOUTHPIECE SIZES WITH EXCELLENT RESPONSIVENESS THROUGH ISOLATION OF LIGATURE FROM REED AND MOUTHPIECE VIBRATIONS

CROSS-REFERENCE TO RELATED APPLICATIONS

BACKGROUND OF THE INVENTION

1. Field of Invention

A ligature system adjustable to fit most saxophone and clarinet mouthpiece is disclosed with improved responsiveness to player.

2. Description of Related Art

U.S. Pat. Nos. 1,449,868, 4,056,997, 4,275,636, 5,000,073, 6,130,376 and 7,737,350 B2

3. Related Art

U.S. Pat. No. 1,449,868 from Miller is an early patent reference for a ligature that uses of a single clamp screw for clamping a reed to a mouthpiece with the screw being attached by a swivel to the bridge of the disclosed ligature. Further details of the swivel attachment are not disclosed.

The concepts disclosed in Miller have evolved and are presently used in currently popular ligatures. An example is the prior art ubiquitous ligature for the Otto Link metal mouthpiece which has a reed contactor which is implemented as a sheet metal pressure plate with a concave surface approximately matching the convex radius of the chosen reed surface. The end of the screw is typically stepped to a cylindrical diameter smaller than the thread diameter which passes through a clearance hole in the metal pressure plate which is thinner than the height of the step. The end is then loosely swaged for retention. This vertical and radial looseness provides a rotational pivoting capability of the reed contactor with respect to the ligature.

By providing very small areas of contact this rotational pivoting mechanism provides excellent mechanical vibrational isolation between the pressure plate and the ligature. The ligature has several problems for meeting the goals that this disclosed invention resolves. First, the ligature still uses a thin metal band that touches a large area of the mouthpiece resulting with limited mechanical vibrational isolation between the vibrating mouthpiece and reed with respect to the ligature. Second, to be adjustable for the full range of saxophone mouthpieces requires a vertical adjustment range of adjustment of almost 0.60 inches. This potentially introduces an over-center stability issue where the structure is may collapse when a reasonably sized adjustment screw is fully extended for use on a small soprano mouthpiece.

U.S. Pat. No. 4,056,997 by Rovner is typical of today's popular saxophone and clarinet ligatures. It discloses a reed holding device for the mouthpiece of a musical instrument in which a single unitary strip extends around and in engagement with the outer surfaces of portions of the reed and the mouthpiece to secure the reed to the mouthpiece. It differs substantially from this disclosed invention as it provides limited isolation from the vibrating reed and mouthpiece as it touches both the reed and mouthpiece with many small areas of contact. An individual ligature has a limited adjustment range and thus it works with a small number of mouthpiece sizes.

U.S. Pat. No. 4,275,636 of Van Doren is another currently popular ligature that touches the clamped single sized reed at two narrow areas of contact that are in a perpendicular direction to those of this disclosure. The outside metal portion of this ligature also directly contacts the mouthpiece at many contact points resulting with many small areas of contact between the mouthpiece and ligature thus limiting its mechanical vibration isolation potential. This is also a ligature designed for use with small range of mouthpiece sizes.

Hite U.S. Pat. No. 5,000,073 discloses a metal ligature that is formed to provide two pairs of circumferential lines 49 & 52 that make contact with the mouthpiece 10. The stated goal of this ligature was to clamp the reed at the reed's nodal points which is a substantially different goal than vibrational isolation as this ligature has many points of contact with a mouthpiece. The Hite invention is also restricted for use to a narrow range of mouthpiece sizes.

Wanne U.S. Pat. No. 7,737,350 B2 discloses a ligature that adapts to all mouthpiece sizes by providing a thin band that encircles the mouthpiece with a player adjustable length. It differs from the present disclosure in two regards. First the tension in the thin metal band is created by the band touching the mouthpiece in many places which typically provides poor vibration isolation. Also the reed contactor has a concave shape which may not be optimal for use with the desired range of four or five reed sizes.

Chang U.S. Pat. No. 6,130,376 is a patent that discloses a ligature that is versatile enough to fit differing sized mouthpieces. To accomplish this goal Chang provides U-shaped ring retaining bars or hooks that accept bead chains or similar elements to provide a split band around the mouthpiece. Different sizes of mouthpieces are adjusted by selecting a different number of beads or elements to change the length of the band. This approach touches the mouthpiece at each bead which provides many more small areas of contact between the mouthpiece and ligature than this disclosed invention thus probably having poorer mechanical vibration isolation.

An aspect of most prior art ligatures is that the one or two pairs of screw threads are used for tightening the reed to the mouthpiece. These screw threads are either at the top or bottom of the mouthpiece and the axes of theses threads is typically horizontal.

Another characteristic of many prior art ligatures is that there are many points of contact between the ligature and the mouthpiece and these contact points can be unevenly distributed. This can result with substantially different responsiveness to the player from nominally identical ligatures while a musician plays with the same horn, mouthpiece and reed.

It is well understood that in a typical mechanical, single reed woodwind musical instrument, energy in a steady air stream is converted to airborne acoustical energy by virtue of the air stream being throttled by an air actuated vibrating reed, with the acoustical output usually being coupled to a resonant air column to produce musical sounds. This effect can be described as the "air" sound of the instrument.

The second major sonic component of a woodwind instrument is the conversion into sound of the mechanical vibrations of the body of the instrument. This can be described as the "body" sound of the instrument. The second important component of the woodwind sound is not as well understood in the ligature prior art. An important source of excitation for this body sound is the mechanical vibrations of the mouthpiece-reed-ligature system. The responsiveness felt by the player and the characteristic sound of the instrument are influenced by this "body" sound. The design, construction and the adjustments by the player of a ligature have an important effect upon the amplitude and quality of body sound produced. The majority of sound produced by the instrument is the combination of the air and body sounds.

Some woodwind players have occasionally left a reed and ligature on a mouthpiece while the instrument is left on its stand or put in a case. In this situation the dried player's saliva will sometimes hold the reed on to the mouthpiece such that it can be played without a ligature. This situation provides excellent acoustic performance and responsiveness to the player up until the weak 'saliva adhesive' bond breaks and the reed pops off. This configuration enables the attached reed to fully to excite the mouthpiece and the attached instrument body to produce a desired musical tone without the loss of vibrational energy from friction and unwanted excitation of undesirable vibrational modes otherwise occurring within a conventional ligature structure.

This 'saliva ligature' experiment demonstrates excellent responsiveness to a player where the absence of a ligature theoretically provides the ideal of 100 percent isolation. The level mechanical vibrational isolation of a particular ligature can be subjectively measured when a competent sax player with his or her own instrument, mouthpiece and reed compares a ligature to this ideal 'saliva ligature'. A high level of vibration isolation is demonstrated when this competent sax player can tell very little difference in responsiveness or sound between a ligature under test and the above "saliva adhesive" ligature.

BRIEF SUMMARY OF THE INVENTION

This invention relates to mechanical, single reed musical instruments such as clarinets, saxophones and the like and more particularly to a device typically called a ligature that is used for clamping a reed onto the typically removable mouthpiece of the musical instrument.

In some embodiments of the disclosed invention a ligature system is adjustable to fit most saxophone and clarinet mouthpiece sizes and achieves excellent mechanical vibrational isolation of the ligature from the vibrating mouthpiece and reed by providing minimal contact with the reed and mouthpiece for improved responsiveness to the player.

An objective of this invention is to enable a single individual ligature to be adjusted by the player to fit and play on mouthpieces as large as a rubber baritone saxophone mouthpiece and on smaller tenor, alto, and on small soprano saxophone mouthpieces as well as most clarinet mouthpieces.

A further objective of this invention is to provide a smaller sized ligature for use where the largest compatible mouthpiece is smaller than the largest mouthpieces. For example it could be sized for a metal tenor saxophone mouthpiece rather than a large rubber baritone mouthpiece. This smaller sized ligature would also have the capability for use with smaller sizes of mouthpieces (i.e. metal alto and soprano mouthpieces).

Providing a stable ligature is an additional objective of this invention. Assembly stability requires that a practical ligature for a conventional mouthpiece and reed must generate sufficient contact friction forces with the mouthpiece and reed such that it will not slip off of the mouthpiece during use. Structural stability requires that the mechanism does not collapse during installation, tightening, musical performance or storage. Structural stability of most prior art ligatures is achieved by the contact friction achieved by having the ligature touching the mouthpiece and reed at many contact points. An objective of this invention is to prevent the potential instability issues that are introduced with the goal minimization of the number of contact points between the ligature and mouthpiece and also between the ligature and reed.

In accordance with the teachings of the present invention, there is disclosed a ligature system and ligature components for use on a mouthpiece of a woodwind type single reed musical instrument. The frame of reference for this disclosure is that of a musician producing a musical note on a woodwind instrument with a mouthpiece, reed and ligature installed. The terms 'top', 'bottom', 'left' and 'right', 'upper' and 'lower', 'vertical' and 'horizontal' also refer to this same point of view. A coordinate system using this same frame of reference has a horizontal 'x' axis, and a vertical 'y' axis with a 'z' axis toward and away from the musician.

The first characteristic of this disclosed ligature is its universal adjustability to fit most saxophone and clarinet mouthpieces with a single ligature using several disclosed embodiments.

This feature of universal adjustability is achieved by providing the ligature with geometries that correctly contact a wide range of mouthpiece sizes and shapes and also properly contact standard reed sizes.

The second feature of universal adjustability is the several disclosed adjustment means in the 'y' direction that provide a vertical range of adjustment that enables a single ligature to operate over a wide range of mouthpiece sizes.

A disclosed embodiment of universal adjustability uses a pair of parallel vertically oriented threads with one on the left side of the mouthpiece and another on the right. The lower structure with a pivotally attached reed contactor contains a pair of clearance holes which accept the pass-through of the pairs of above threads and provides nuts or screws for the vertical adjustment for the selected range of mouthpiece sizes.

The second main concept of this disclosed ligature is the isolation of the ligature from the mouthpiece and the reed by the careful minimization of contact between the various components to reduce the amount of mechanical vibrational energy transmitted from the mouthpiece and reed into the ligature thereby reducing the negative acoustic effects of the ligature.

This vibrational isolation is achieved first by reducing the contact between the mouthpiece and ligature to only one or two very small areas of contact. Additionally a reed contactor is provided that touches the reed with only two parallel narrow areas of contact and finally the reed contactor is isolated for mechanical vibrations from the ligature by two exemplary embodiments of a low friction rotational pivot between the lower structure the reed contactor.

The third main feature of this disclosed ligature is compatibility with commonly existing mouthpieces and reeds without requiring modification of either the reed or mouthpiece.

BRIEF DESCRIPTION OF THE SEVERAL VIEWS OF THE DRAWINGS

The first exemplary embodiment is shown in FIGS. 1A through 1H.

FIG. 1A is an oblique view of the disclosed ligature holding a baritone sax reed on a very large rubber baritone saxophone mouthpiece. FIG. 1B is an oblique view of the disclosed ligature holding a soprano sax reed on a very small plastic soprano saxophone mouthpiece.

1F shows the disclosed ligature installed with a tenor sax mouthpiece that has a 'bump' at its top and demonstrates that contact by the ligature of the 'bump' is avoided.

FIG. 2A is a symmetrical central side view cross section of a reed installed on a mouthpiece with this pivot configuration. FIG. 2B is a cross sectional view of FIG. 2A sliced through the plane of symmetry for the upper structure. FIG. 2C is an enlargement of the details of the rotational pivot arraignment shown in 2A.

DETAILED DESCRIPTION OF THE INVENTION

Figure 1A:
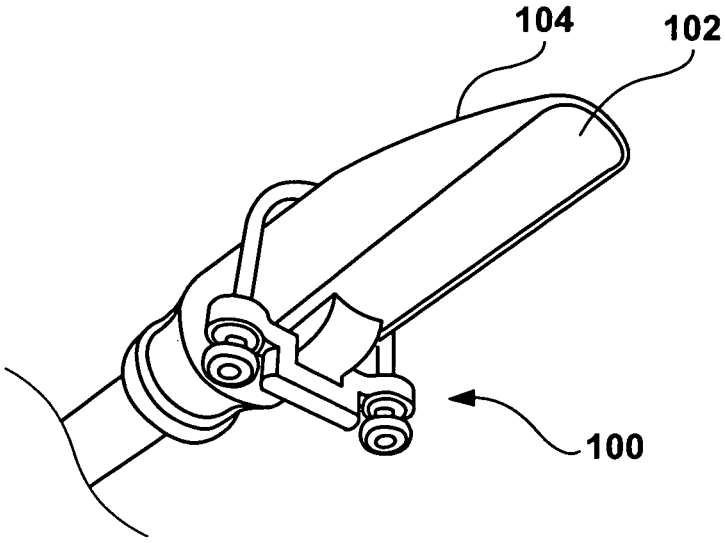
FIGS. 1A and 1B demonstrate first exemplary embodiment ligature being used on a large and a small saxophone mouthpiece.
Figure 1B:
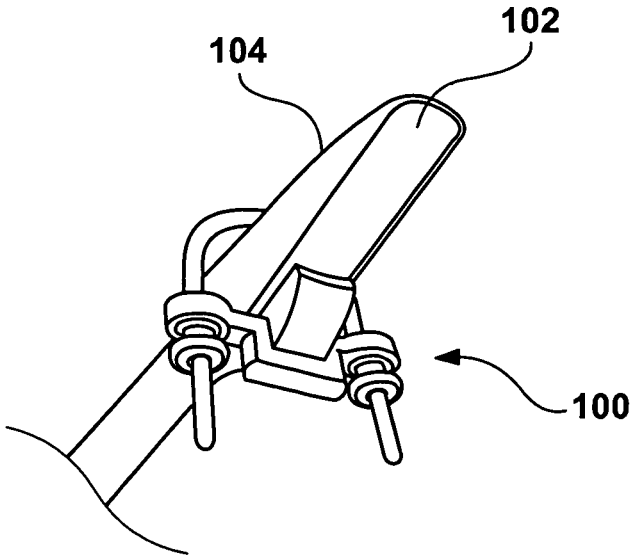

One exemplary embodiment discloses a ligature system for single reed woodwind instruments that provides the ability to easily install the disclosed ligature on both large and small mouthpieces. FIG. 1A and FIG. 1B show this capability.

Figure 1C:
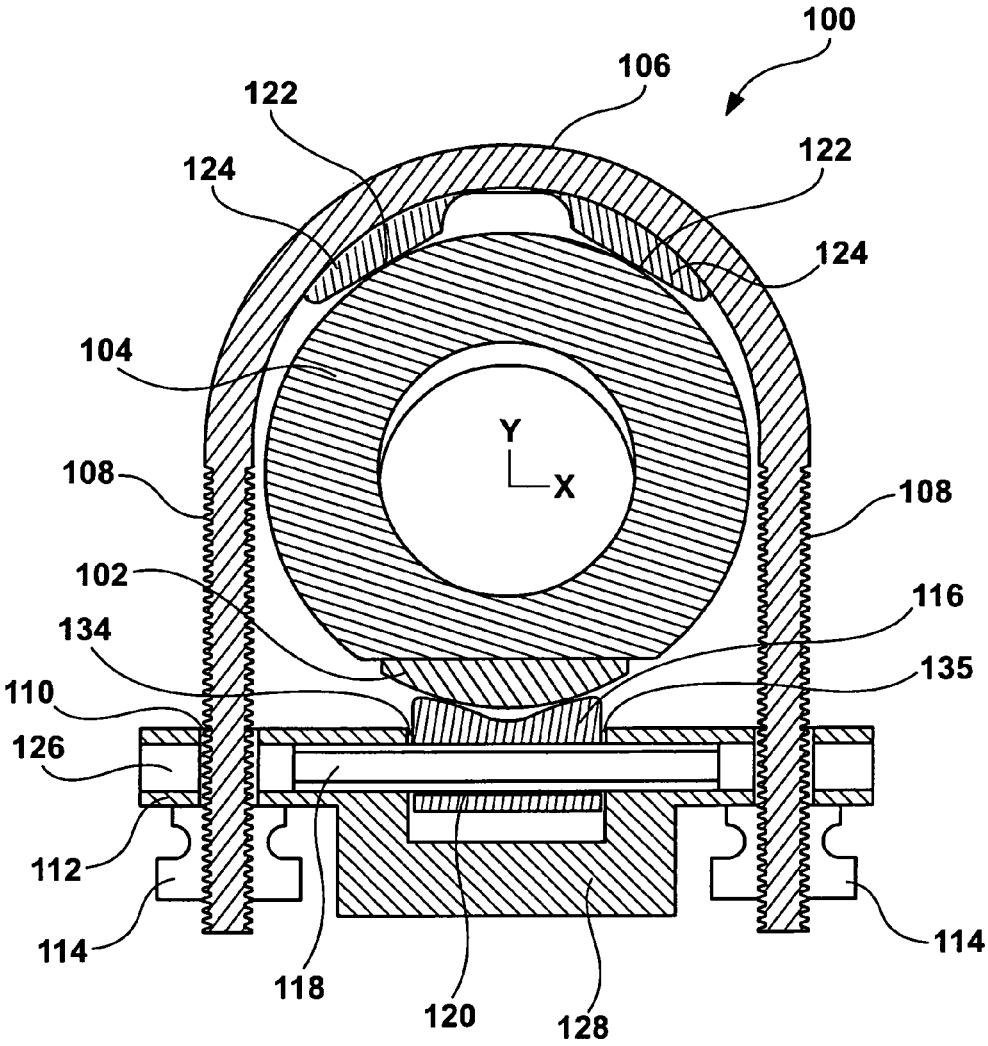
FIG. 1C and FIG. 1D are frontal cross sectional views of the mouthpiece-reed-ligature systems shown in FIGS. 1A and 1B. The cross sectional split for these views is the plane of symmetry for the upper structure.

FIG. 1C is a cross sectional view showing the ligature 100 clamping a properly aligned baritone saxophone reed 102 to a large hard rubber baritone saxophone mouthpiece 104. The upper structure 106 has two integrated externally threaded rods 108 which pass through clearance holes 110 of lower structure 112 and provide a vertical threaded means on its left and right sides when secured by two knurled thumb nuts 114. These nuts are tightened to provide the clamping forces to hold the reed 102 to the mouthpiece 104.

Figure 1D:
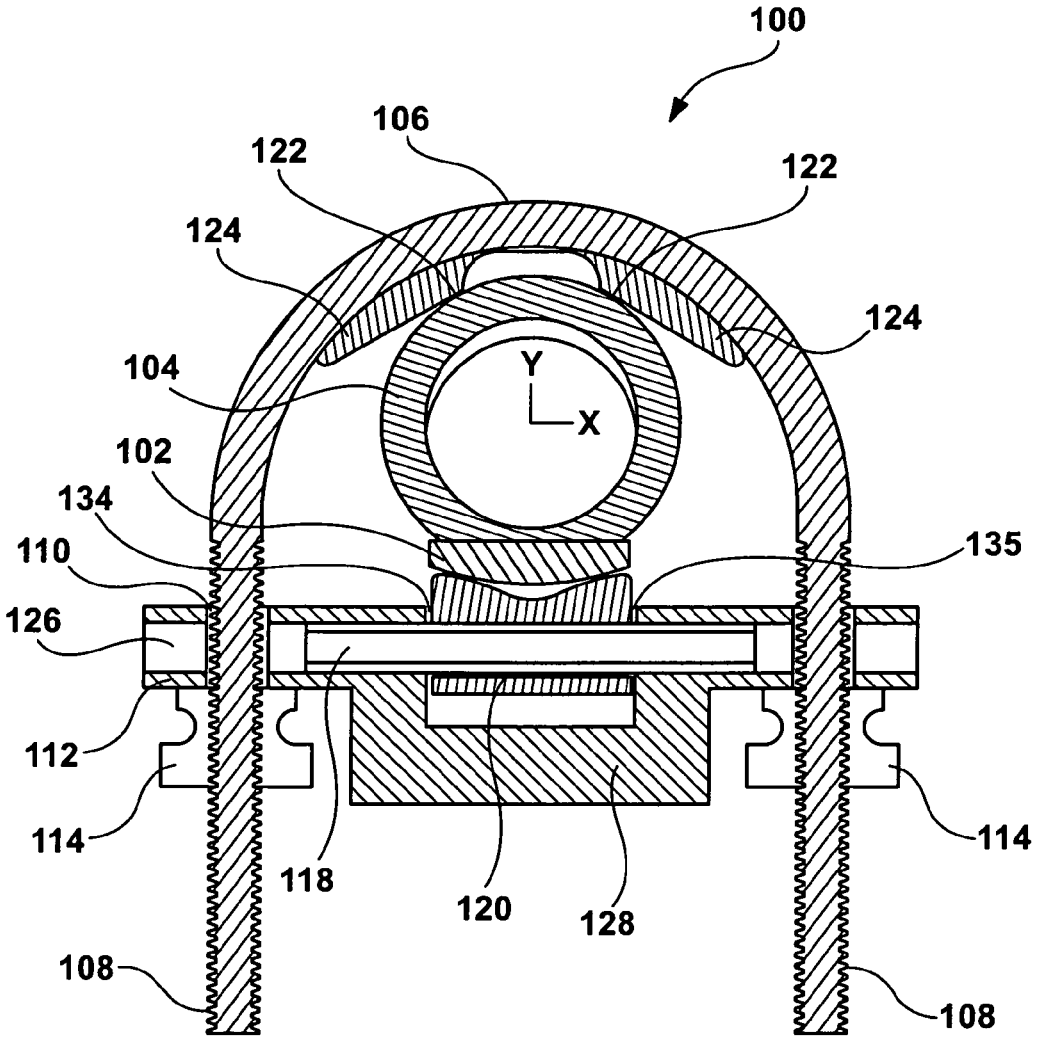

FIG. 1D is a cross sectional view showing the ligature mouthpiece reed system 100 clamping a properly aligned soprano saxophone reed 130 to small soprano saxophone mouthpiece 132. The other elements are numbered as in FIG. 1C.

In FIG. 1C the reed contactor 116 is shown touching the reed 102 at two points which create two narrow areas of contact between reed 102 and reed contactor 116. The reed contactor 116 is captured by the lower structure 112 using a horizontal cylindrical slotted spring pin 118 which passes through a clearance hole 120 in reed contactor 116. The width of reed contactor 116 is narrower than opening 119 in lower structure such that a gap 134 on the left side or 135 on the right side is available to allow for low friction rotation of reed contactor about horizontal slotted spring pin 118. The sum of the two gaps 134 and 135 of between 0.003 to 0.02 inches is needed for this exemplary embodiment.

For this exemplary embodiment the two mouthpiece contactors 124 are desirable to provide geometric stability of the ligature such that the mouthpiece 104 remains centered in a stable position when knurled thumb nuts 114 are tightened. Uneven tightening of thumb nuts 114 may cause the upper structure 106 to slip to the left or right side resulting in non-symmetrical contact between ligature 100 and mouthpiece 104 possibly resulting in reduced mechanical vibrational isolation between the ligature 100 and the vibrating reed 102 and mouthpiece 104 during use.

The two mouthpiece contactors 124 are integrally attached to upper structure 106 and create two small approximately symmetrical areas of contact 122 between the mouthpiece contactors 124 and mouthpiece 102. The exemplary shape of the mouthpiece contactors is approximately planar and the two contactors are preferably symmetrical placed at an approximate angle of 120 degrees±5 degrees from the vertical axis with the symmetry more important than the angle.

The exemplary material for reed contactor 116 and mouthpiece contactors 124 is an injection moldable plastic with a relatively high coefficient of sliding friction, such as ABS or Polycarbonate plastic or a mixture of the two. Experiments show the use of Acetal plastic or other low sliding friction plastic for either contactor allows the ligature to slip during the tightening process on some mouthpieces. The absence of plastic mouthpiece contactors 124 provide excellent responsiveness from the contact between two curved convex surfaces when carefully centered by the player but may cause the metal surface of upper structure 106 to dent, mark or damage the top of some types of mouthpieces 104 or 132 when the cross section of upper structure 106 at the single point of contact is approximately round. Adding a convex plastic mouthpiece contactor at the central top location of the mouthpiece solves this issue.

The exemplary embodiment for the upper structure 106 has an internal width between its externally threaded rods 108 of at least 1.32 inches with sufficient left-right clearance provided such that the upper structure only touches the large mouthpiece at the desired points, and the required range of travel of the two knurled thumb nuts 114 along the externally threaded rods 108 of upper structure 106 is at least 0.59 inches to be able for use for both baritone sax mouthpiece 104 and reed 102 and for soprano mouthpiece 132 and reed 130. The exemplary height of upper structure 106 is 2⅛ inches with a thickness of approximately ⅛ inch. The preference for the externally threaded rods 108 that are integral to upper structure 106 are of size UNC 6-32 2A with matching brass knurled thumb nuts 114 with thread size UNC 6-32 2B. The brass knurled thumb nuts are commercially available (McMaster-Carr part number 92741A110). This thread size is not critical but it adapts easily for the use for construction of upper structure 106 adding threads 108 to a straight round ⅛ inch diameter half hard brass rod which is bent into the semicircular shape as shown in FIGS. 1C and 1D.

The required tolerances for the alignment of approximately parallel pair of threaded rods 108 is that that the two rods pass through a precision gage with two parallel 0.150 diameter holes with a spacing of 1.460 inches between the hole centers to a depth of ⅝ inch without binding.

The exemplary material of the lower structure 112 is injection molded Acetal plastic. With a horizontal mold parting plane through the center line of pin hole 126 the two 0.150 inch diameter clearance holes 110 are easily molded while pin hole 126 may be need to be machined as a secondary operation to enable a simple injection mold to be constructed.

Figure 1E:
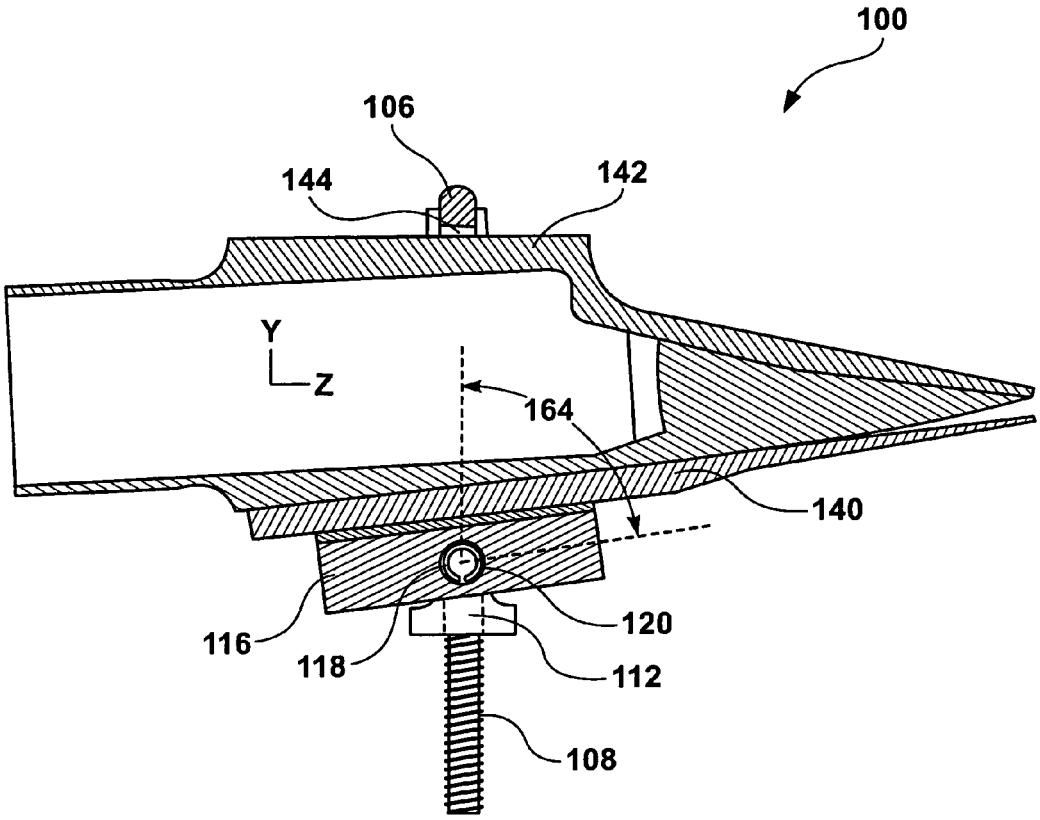
FIG. 1E shows a side central cross sectional view of the disclosed ligature in use with a tenor sax mouthpiece and reed for the disclosure of the rotational pivot pin mechanism. FIG.

Slotted spring pin 118 is preferentially a ⅛ inch diameter 303 stainless steel with a 1.25 inch nominal length installed such that the slot of the pin is at the bottom such that it is not making contact with reed contactor 116 during use as shown in FIG. 1E. Pin 118 must also not protrude into clearance holes 110 of lower structure 112 to prevent undesired contact with threaded rods 108. A solid stainless steel or brass pin may be used as an alternative to slotted spring pin 118.

The ability of the reed contactor 116 with clearance hole 120 to roll around near the top of cylindrical slotted spring pin 118 creates a low friction pivot which rotates to compensate for a tilt angle 164 between the reed 102 and the top of the mouthpiece as shown in FIG. 1E. This tilt angle 164 can vary between different typical mouthpieces such as 104, 132 and 142 which is typically in a range between 70 and 90 degrees. FIGS. 1C, 1D and 1E show the clearance hole 120 of reed contactor 116. Alternatively the clearance hole may be provided in the lower structure with the cylindrical pin secured to the reed contactor.

The lower structure beam 128 restricts the total rotation angle of mouthpiece contactor 116 to less than 120 degrees to insure that the correct surface of reed contactor 116 and not the bottom side of 116 touches the reed 102 for easy use by the musician.

Lower structure 112 with beam 128 could alternately be split into pair of left and right individual parts or be integrated with the pin into a single machined metal part. Rotation limiting features may be needed on reed contactor 116 and ligature body 112 for this alternative embodiment.

With a lower structure 112 and pin 118 integrated into a single metal part, reed contactor 116 would need an installation slot into hole 120 along its bottom for the snap-in of reed contactor 116. A retention means would be needed for installation and retention of reed contactor 116 by integrated pin feature 118. This retention means could be achieved by an interference fit between the installation slot and the pin as is well known in the art. An interference fit of 0.005 to 0.010 inches between the pin diameter and the slot would enable installation and part retention.

Figure 1F:
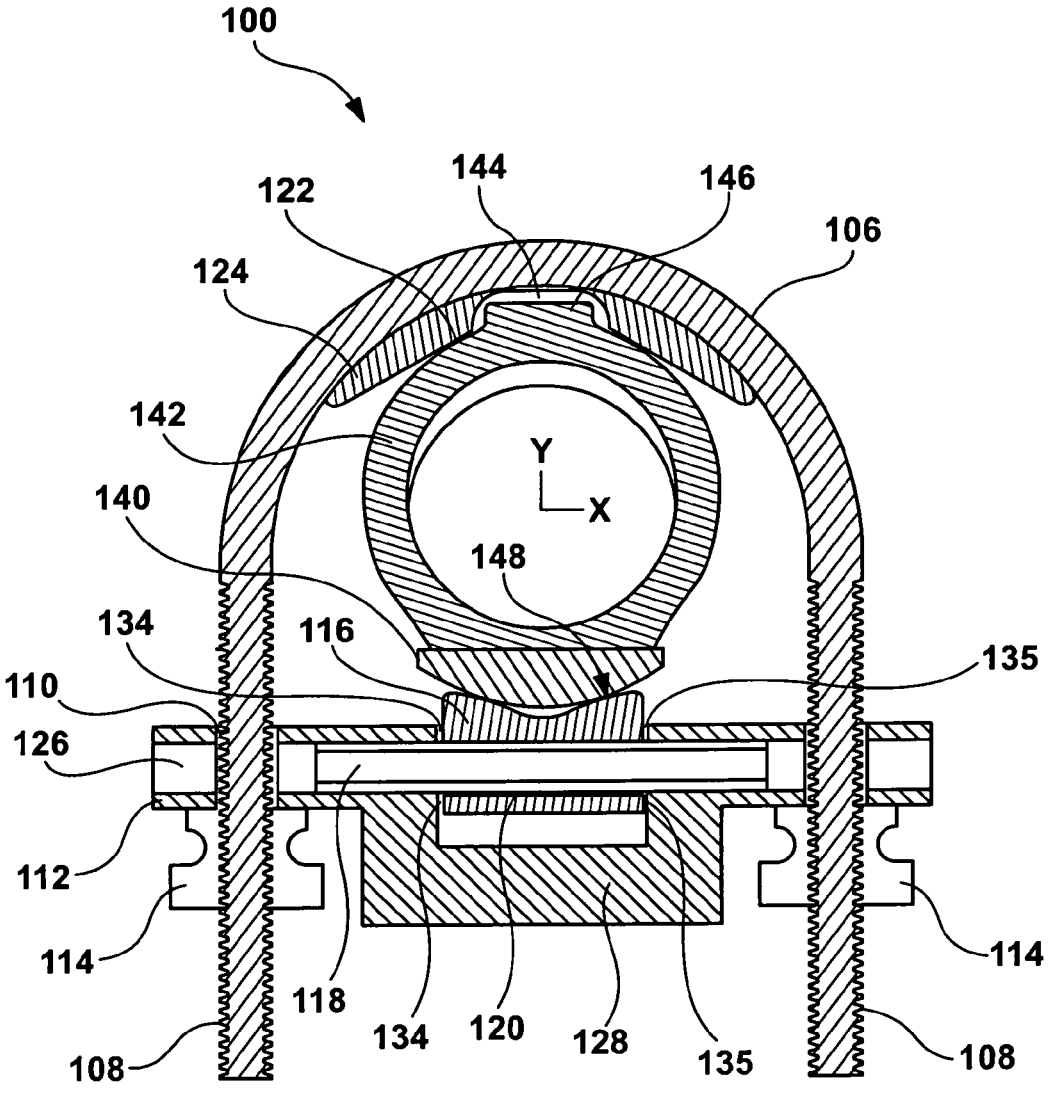
FIGS. 1G and 1H show the geometric details of the reed contactor for a first exemplary embodiment.

FIG. 1F features a tenor saxophone reed 140 that is clamped to mouthpiece 142 by ligature 100. Mouthpiece 142 has a flat protruding bump 146 at its top which is typical of the in the style of the famous Otto Link metal mouthpiece. This disclosed ligature 100 has a gap 144 between the two mouthpiece contactors 124 to eliminate contact between ligature 100 and bump 146 to provide excellent responsiveness with this particular type of mouthpiece.

Figure 1G:
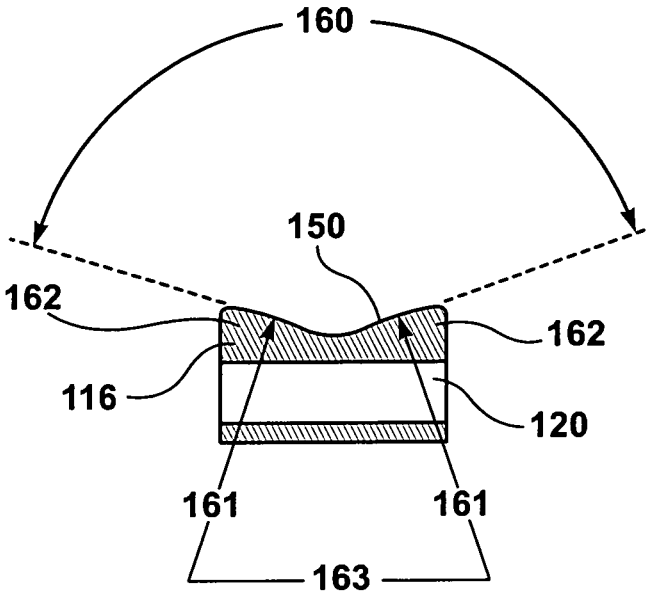
Figure 1H:
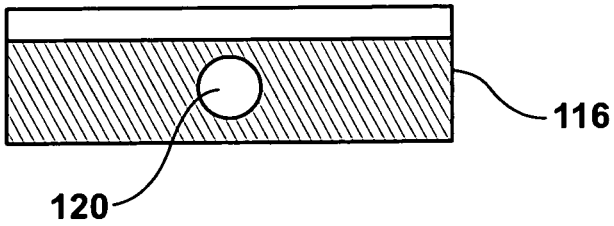

Conventional reeds have an approximate bottom radius 148 as shown in FIG. 1F that varies both with different individual reed sizes and within reeds of the nominally same size. Reed contactor 116 has a contact surface 150 shown n FIG. 1G that is essentially symmetrical about a vertical axis which is comprised of two blended or intersecting convex arcs 161 with an approximate radius of 0.6 inches with centers 163 separated by about 0.67 inches. The two blended radii 162 of about 0.02 inches break the sharp edge of each of the arcs 161. The two arcs 161 are cosmetic and may be replaced with two symmetrical blended or intersecting planes separated by a non-critical angle 160 of approximately 144 degrees. The symmetry of surface 150 with respect to the top of clearance hole 120 within 2 degrees is the important criteria. These pairs of arcs or planes 161 may be interrupted by gaps in the long direction of the reed without sacrificing responsiveness or clamping performance. This configuration creates two essentially parallel narrow linear areas of contact that minimizes the contact with various reeds 102, 130, 142 and others and also provides self-location of the reed contactor onto a reed except in the y-z direction along the length of the curved bottom of the given reed. The exemplary size of reed contactor 116 is 1.0 inches long by 0.5 inches wide and 0.3 inches thick as shown in FIGS. 1G and 1H. The clearance hole 120 in reed contactor 116 is also clearly visible in FIGS. 1E and 1F. The exemplary size of clearance hole 120 for a ⅛ inch pin diameter is 0.136 inches. The basic shape show for reed contactor 116 is rectangular but pockets in non-critical areas would probably need to added for injected molded production parts as is well known in the art.

The process for moving the ligature 100 from mouthpiece 104 with reed 102 and installation on mouthpiece 132 with reed 130 is as follows. Knurled thumb nuts 114 are loosened on ligature mouthpiece system 100 in FIG. 1C until the ligature 100 can slide on mouthpiece 104 such that reed 102 can be carefully removed. The ligature 100 is then removed completely from mouthpiece 104. The ligature is then installed on the soprano sax mouthpiece 132 with reed 130 and knurled thumb nuts 114 are evenly tightened until the ligature 100 almost fits at the correct location on mouthpiece 132. Reed 130 is now inserted and aligned while lower structure 112 is finger pressed with one hand for alignment such that there is no gap between reed contactor 116 and reed 130. Fingers on the other hand then gently tighten both knurled thumb nuts 114 to remove the gaps. Both nuts 114 are then evenly tightened to clamp the reed 130 to mouthpiece 132.

Note that the adjustment process between different mouthpiece sizes requires threads 108 and thumb nuts 114 occur with one male-female pair occur on the left side of the mouthpiece and another on the right side. The axis of these threads are essentially both parallel and vertical to enable the large range of adjustment needed for use with large and small mouthpieces.

Figure 2A:
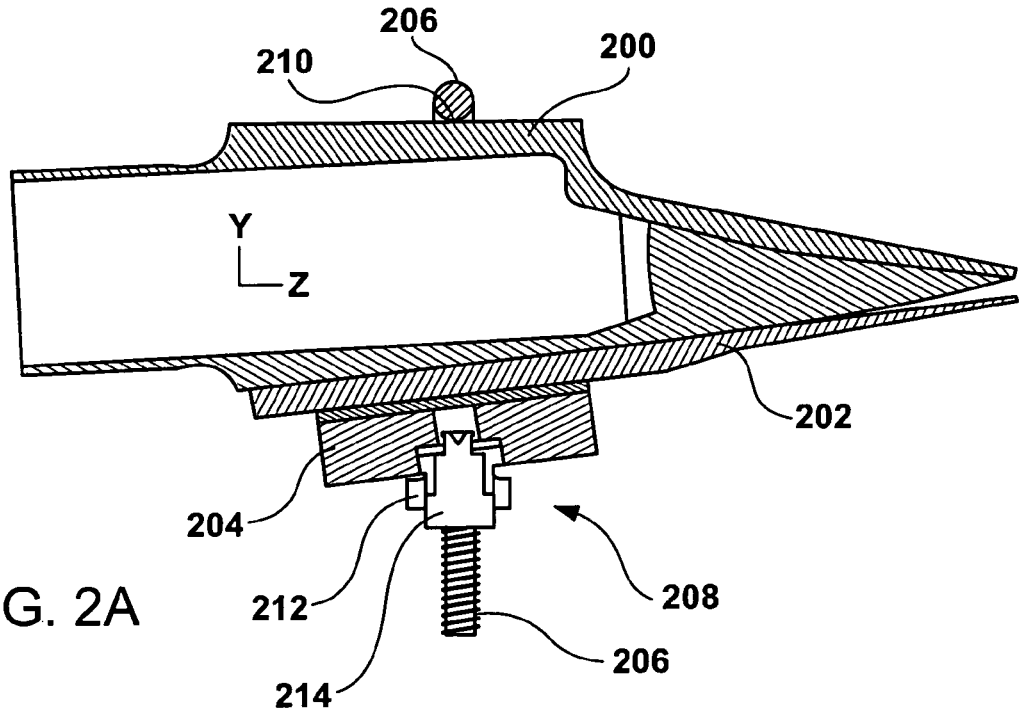
FIGS. 2A-2C display an exemplary embodiment that with an alternative rotational pivot mechanism for attaching reed contactor to the lower structure.
Figure 2B:
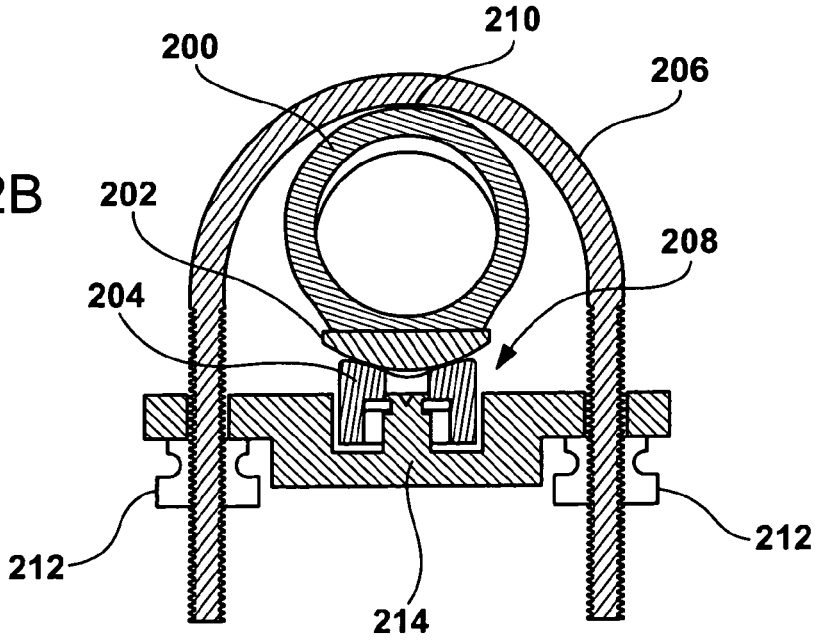
Figure 2C:
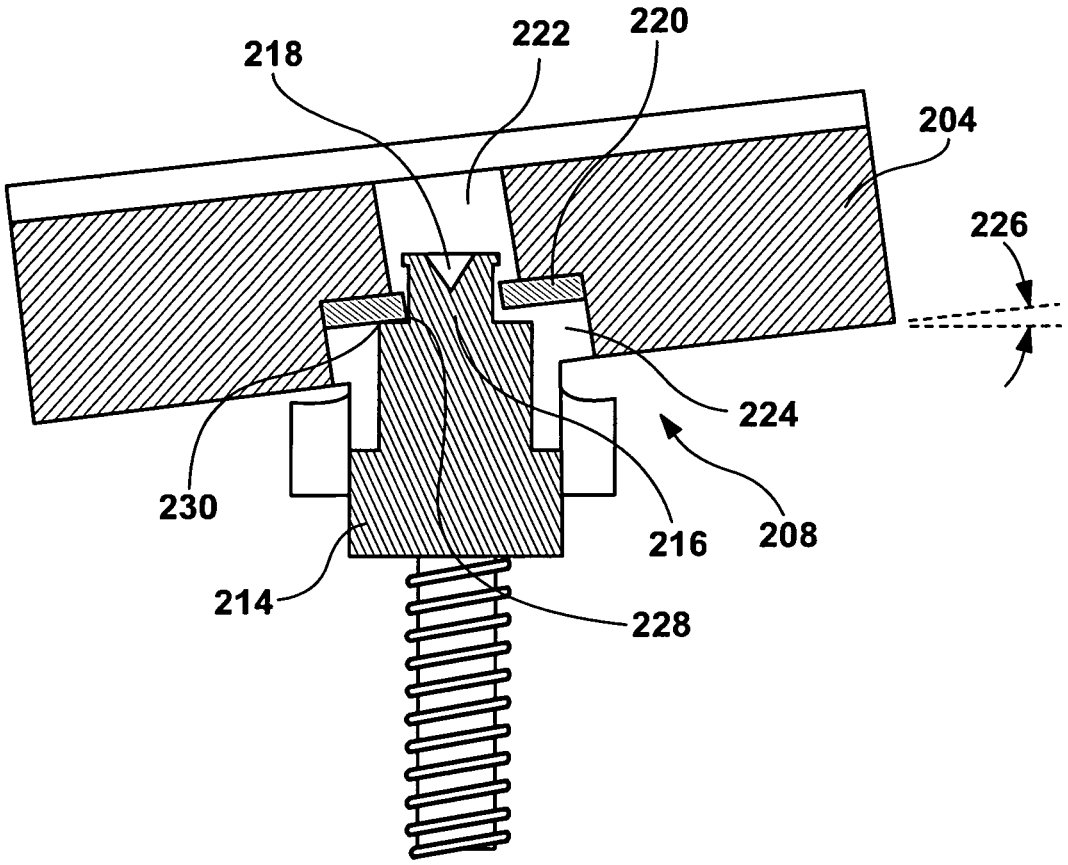

FIGS. 2A-2C are used to disclose a second exemplary embodiment of a rotational pivot mechanism. FIGS. 2A and 2B show properly adjusted reed 202 installed onto mouthpiece 200 by reed contactor 204 which is being clamped by the pressure exerted by left and right thumb screws 212 on lower structure 214 through rotational pivot assembly 208. FIG. 2C display the details of the second exemplary rotational pivot means 208 which is assembled as follows. Reed contactor 204 has steel washer 220 securely press fitted into cylindrical hole 224. Stepped cylindrical pin 216 which is integral or securely attached to lower structure 214 has its upper and smaller diameter passing through clearance hole in steel washer 220. Reed contactor 204 has a clearance hole 222 which allows the end of stepped pin 216 to be struck with a chisel point at 218 which creates a swaged flange which retains reed contactor 204 onto lower structure 214.

A rotational pivot mechanism is created as follows. The radial and vertical clearances between washer 220 and the small diameter of cylindrical stepped pin 216 provide both small radial and axial clearances which provides a rotational pivoting capability of the reed contactor with respect to the ligature.

When a reed is clamped the tilt angle 226 between the reed contactor 204 with its installed washer 220 and the step of cylindrical stepped pin 216 force the left side of washer 220 to contact the left side of stepped pin 216 at intersection point 228 to react to the horizontal clamping forces. Similarly the vertical contact forces are reacted at point 230 which is intersection point between the outer diameter of stepped pin 228 and the flat bottom surface of washer 220. The result of this configuration is that very small areas of contact are created thus providing excellent mechanical vibrational isolation between the reed contactor assembly and the lower structure.

The geometry and properties of reed contactor 204 are very similar to those described above for the previous embodiment where clearance hole 120 in reed contactor 116 would be replaced by clearance holes 222 and 224 in reed contactor 204. An alternative embodiment of reed contactor 204 and washer 220 could be formed as a sheet metal part as mentioned above of the Otto Link metal mouthpiece ligature. A vertical screw for retention of reed contactor 204 into stepped pin 216 could alternatively be used to replace swage point 218 by a female threaded hole.

Stepped pin 216 is shown in FIGS. 2A-2C as being an integral part of lower structure 214. It could easily be constructed as a separate pin or screw that is appropriately installed into lower the lower structure. An upper diameter of 0.125 inches with a larger diameter of at least 0.175 inches and a step height of at least 0.090 inches is preferred to reach a maximum tilt angle 226 approaching 15 degrees.

The preferred washer 220 is a stainless steel washer with an inside inches diameter of 0.125, an outside diameter of 0.300 and a thickness of 0.032. A press fit of washer 220 into hole 224 in plastic reed contactor 204 can be achieved with an interference fit of 0.002 to 0.003 inches.

In summary this patent discloses a single reed woodwind ligature system comprising an upper structure that provides a means for contacting the upper portion of a mouthpiece at one or two small areas of contact. Also provided are a reed contactor that is capable of contacting a reed at its bottom curved surface, a lower structure that attaches the reed contactor using a rotational pivot mechanism. Also provide are a left side and right side vertical adjustment capability that can clamp the upper structure to the lower structure with the capability to vary the distance between said upper and lower structures to enable the clamping of a reed to a mouthpiece.

The above left side and right side vertical adjustment capability in the previous paragraph can be provided by a pair of vertical threaded elements that pass through a left side and a right side clearance hole in either the upper structure or the lower structure where the threaded elements are secured by a left side and a right side finger rotatable nuts or screws where rotation of the nuts or screws move the lower structure away or toward the upper structure to provide a capability for clamping and unclamping a reed to a mouthpiece.

A particular embodiment of the disclosed single reed woodwind ligature system has the upper structure containing a left side and a right side pair of externally threaded rods and the lower structure containing a left side and a right side pair of vertical clearance holes where during use said externally threaded rods of the upper structure pass through clearance holes and the upper structure is clamped to the lower structure by the installation of left a side and a right side pair of rotatable finger nuts which when rotated provide the capability for clamping a reed to a mouthpiece.

The capability to vary the distance with the disclosed ligature between the upper and lower structures needs a range of travel greater than 0.125 inches to enable use by a single ligature with two adjacent sizes of mouthpieces in the saxophone family. Adjacent mouthpiece sizes are soprano and alto, alto and tenor, or finally tenor and baritone.

The capability to vary the distance with the disclosed ligature between the upper and lower structures in needs a range of travel greater than 0.50 inches to enable use by a single ligature with many typical sizes of soprano, alto, tenor or baritone saxophone mouthpieces.

Use by the disclosed ligature with the large mouthpieces requires the left side and the right side vertical clamping adjustment to provide a horizontal width of clearance greater than 1.25 inches such that a properly adjusted ligature will not interfere at the largest width of many large sized saxophone mouthpieces.

The disclosed upper structure can be constructed by the bending and threading of an initially approximately round and straight solid metal rod into a 'U' shaped configuration.

During use the upper structure of the disclosed ligature can provide in the x-y plane a convex curved intersection surface that provides a single small area of contact between the upper structure near the top of most installed mouthpieces.

Another feature integral or securely attached to the upper structure of the disclose ligature can provide an approximately symmetrical left small contact area and a right side small contact area during use with an installed mouthpiece.

An optional feature that can be provided between the approximately symmetrical left contact area and right contact area mentioned in the above paragraph is a top central clearance gap such that the ligature system can avoid contact during use with the top bump on an 'Otto Link' style metal saxophone mouthpieces.

The small contact areas between an installed mouthpiece and the upper structure mentioned in this disclosure can approximate a small circular area when both contacting surfaces are convex or can approximate a narrow area along a line when the contacting structure of the upper structure is essentially planar.

The disclosed contacting surface elements between the upper structure and an installed mouthpiece can be an integral part of the upper structure or can consist of a separate part or parts securely attached to the upper structure.

The disclosed contacting surfaces attached to the upper structure which provide contact to an installed mouthpiece can be made of metal or plastic.

The disclosed reed contactor is capable of contacting a properly aligned reed on the reed's long curved surface along two approximately parallel and symmetrical left side and right side narrow small areas along a line in the longest direction of the reed with contact provided by a pair of surfaces that are symmetrical about a vertical axis which is comprised of two blended or intersecting planes or two blended or intersecting convex surfaces.

The narrow small areas of contact of the disclosed reed contactor with an installed reed can be interrupted into several independent areas separated by gaps in the reed contactor in the long direction of a properly installed reed.

The disclosed reed contactor can be made of plastic, steel or brass.

The first embodiment of the rotational pivot means can be provided by an essentially horizontal pin secured or integral to the lower structure. The pin passes through a clearance hole in the reed contactor with a side clearance gap to prevent binding. Alternatively the rotational pivot means can be provided by an essentially horizontal pin secured or integral to the reed contactor that passes through a pair of clearance holes in the lower structure with a side clearance gap to prevent binding.

The disclosed horizontal for the first embodiment of the rotational pivot means can be provided by a stainless steel split spring pin.

The second disclosed embodiment of a rotational pivot means is provided by an essentially vertical stepped metal pin that is integral or securely attached to the lower structure. The smaller diameter of the stepped pin is inserted through a clearance hole in a metal plate that is securely attached or integrally part of the reed contactor. The metal plate is retained to the stepped pin by swaging or by a vertical screw. A rotational pivoting capability is provided by both the radial and vertical clearance between the stepped pin and the clearance hole in the metal plate.

To those skilled in the art, many changes and modifications will be readily apparent from consideration of the foregoing description of a preferred embodiment without departure from the spirit of the present invention, the scope thereof being more particularly pointed out by the following claims. The descriptions herein and the disclosures hereof are by way of illustration only and should not be construed as limiting the scope of the present invention which is more particularly pointed out by the following claims.

I claim:

1. A single reed woodwind ligature system comprising an upper structure that provides a means for contacting the upper portion of a mouthpiece at one or two small areas of contact, a reed contactor that is capable of contacting a reed at its bottom curved surface, a lower structure that attaches said reed contactor by a rotational pivot means, a left side and right side vertical adjustment means that can clamp said upper structure to said lower structure with the capability to vary the distance between said upper and lower structures to enable the clamping of a reed to a mouthpiece.

2. The single reed woodwind ligature system of claim 1 where a left side and right side vertical clamping adjustment means is provided by a pair of vertical threaded elements that pass through a left side and a right side vertical clearance hole in either the said upper structure or said lower structure where said threaded elements are secured by a left side and a right side finger rotatable nuts or screws where rotation of said nuts or screws move the lower structure away or toward the upper structure to provide a means for clamping and unclamping a reed to a mouthpiece.

3. The single reed woodwind ligature system of claim 2 where the said upper structure contains a left side and a right side pair of externally threaded rods and said lower structure contains a left side and a right side pair of vertical clearance holes where during use said externally threaded rods pass through said clearance holes and said upper structure is clamped to said lower structure by the installation of left a side and a right side pair of rotatable finger nuts.

4. The single reed woodwind ligature system of claim 1, wherein said capability to vary the distance between said upper and lower structures has a range of travel greater than 0.125 inches to enable use by a single said ligature with two adjacent sizes of mouthpieces in the saxophone family where typical adjacent mouthpiece sizes are soprano and alto, alto and tenor, and finally tenor and baritone.

5. The single reed woodwind ligature system of claim 1, wherein said capability to vary the distance between said upper and lower structures has a range of travel greater than 0.50 inches to enable use by a single said ligature with many typical sizes of soprano, alto, tenor or baritone saxophone mouthpieces.

6. The single reed woodwind ligature system of claim 1, wherein said left side and fight side vertical clamping adjustment means provides a horizontal width of clearance that is greater than 1.25 inches such that said properly adjusted ligature will not interfere at the largest horizontal width of many large sized saxophone mouthpieces.

7. The single reed woodwind ligature system of claim 1, wherein said upper structure is constructed by the bending and threading of an initially approximately round and straight solid metal rod into a 'U' shaped configuration.

8. The single reed woodwind ligature system of claim 1, wherein said upper structure during use of said ligature provides in the x-y plane a convex curved intersection surface that produces a single small area of contact between said upper structure near the top of most installed mouthpieces.

9. The single reed woodwind ligature system of claim 1, further comprising a feature integral or securely attached to said upper structure to provide an approximately symmetrical left side small contact area and right side small contact area during use with an installed mouthpiece.

10. The single reed woodwind ligature system of claim 9, wherein said integral feature contains a top central clearance gap such that said ligature system can avoid contact during use with the top bump on an 'Otto Link' style metal saxophone mouthpieces.

11. The single reed woodwind ligature system of claim 1, wherein said small contact areas between an installed mouthpiece and said upper structure approximates a small circular area when both contacting surfaces are convex or can approximate a narrow area along a line of contact when contacting surface of said upper structure is essentially planar.

12. The single reed woodwind ligature system of claim 8 or 9, wherein said contacting surfaces is an integral part of said upper structure or can consist of a separate part or parts securely attached to said upper structure.

13. The single reed woodwind ligature system of claim 12, wherein said contacting surfaces elements is made of plastic or metal.

14. The single reed woodwind ligature system of claim 1, wherein said reed contactor means contacts a properly aligned reed on the reed's long curved surface along two approximately parallel and symmetrical left side and right side narrow small areas along a line in the longest direction of the reed with said contact provided by a pair of surfaces that are essentially symmetrical about a vertical axis which is comprised of two blended or intersecting planer or two blended or intersecting convex surfaces.

15. The single reed woodwind ligature system of claim 14, wherein the narrow small areas of contact of said reed contactor with said reed are interrupted into several independent areas separated by gaps in said reed contactor in the long direction of a properly installed reed.

16. The single reed woodwind ligature system of claim 14, wherein said reed contactors are made of plastic, steel or brass.

17. The single reed woodwind ligature system of claim 1, wherein said rotational pivot means is provided by an essentially horizontal pin secured or integral to said lower structure that passes through a clearance hole through said reed contactor with a side clearance gap to prevent binding or alternatively the said rotational pivot means is provided an essentially horizontal pin secured to said reed contactor that passes through a pair of clearance holes in said lower structure with a side clearance gap to prevent binding.

18. The single reed woodwind ligature system of claim 17, wherein said horizontal pin is provided by a steel split spring pin.

19. The single reed woodwind ligature system of claim 1, wherein said rotational pivot means is provided by an essentially vertical and centered stepped metal pin that is integral or securely attached to said lower structure where smaller diameter of said stepped pin is inserted through a clearance hole in a metal plate that is securely attached or integrally part of said reed contactor and said metal plate is retained to top of said stepped pin by swaging or by a vertical screw where a rotational pivoting capability is provided by both the radial and vertical clearance between said stepped pin and said clearance hole in said metal plate.

* * * * *